US005864884A

United States Patent [19]

Salvitti

[11] Patent Number: 5,864,884

[45] Date of Patent: Feb. 2, 1999

[54] GUN SUPPORT GLOVE

[76] Inventor: Michael Salvitti, 75 Saratoga Rd., Stratford, N.J. 08084

[21] Appl. No.: 95,917

[22] Filed: Jun. 11, 1998

[51] Int. Cl.[6] ..... A41D 19/00

[52] U.S. Cl. ..... 2/159; 2/160; 2/161.5; 2/161.6

[58] Field of Search ..... 2/158, 159, 160, 2/161.1, 161.5, 161.6, 162, 163, 907, 910, 917; 42/90, 94, 85

[56] References Cited

U.S. PATENT DOCUMENTS

| | | | |
|---|---|---|---|
| 2,083,604 | 6/1937 | Hay | 2/159 |
| 2,522,344 | 9/1950 | Carmin | 2/160 |
| 2,852,779 | 9/1958 | Roessler | 2/159 |
| 3,408,657 | 11/1968 | Gallagher | 2/159 |
| 4,447,912 | 5/1984 | Morrow | 2/159 |
| 4,730,354 | 3/1988 | Saito | 2/159 |
| 5,022,094 | 6/1991 | Hames et al. | 2/161 |
| 5,033,120 | 7/1991 | Myers | 2/161.4 |
| 5,414,868 | 5/1995 | Crawford | 2/160 |
| 5,435,013 | 7/1995 | Davis | 2/161.1 |
| 5,666,667 | 9/1997 | Hook, Jr. | 2/159 |

*Primary Examiner*—Michael A. Neas
*Assistant Examiner*—Gary L. Welch
*Attorney, Agent, or Firm*—Norman E. Lehrer

[57] ABSTRACT

A glove for supporting a gun even when the person wearing the glove is not actively gripping the gun is disclosed. The glove includes a covering for a hand of a person, the covering has a back side, a palm side, an extended thumb section, and separate finger sections for each finger. At least one of the finger sections has an opening therethrough. The thumb section has a slit therethrough. The glove has a strap with two ends where a first end extends from the thumb slit and a second end extends outwardly from the finger section opening, with the mid-portion of the strap extending within the interior of the covering. The ends of the strap have fasteners thereon so that the two ends may be fastened together and through which the handle of the gun may be supported. In a first embodiment the thumb and finger sections are open and in a second embodiment the thumb and finger sections are closed. In order to release the gun the fasteners are released and the first end of the strap is secured to a fastener on the back side of the covering.

13 Claims, 3 Drawing Sheets

GUN SUPPORT GLOVE

BACKGROUND OF THE INVENTION

The present invention is directed toward a glove and more particularly toward a glove for supporting the handle of a gun even when the person wearing the glove is not actively gripping the gun.

Law enforcement personnel, and in particular, police officers carry handguns. A common problem a police officer faces when pursuing a person or persons is that his or her gun may slip from his or her hand and accidentally fall. There are many types of gloves which may aid a person to grip an object, particularly when playing a sport. For example, and as discussed below, there are gloves which help a person to grip a pole, a golf club, a bat, or racket. However, there remains a need for a glove which helps a person grip a gun.

U.S. Pat. No. 5,666,667 to Hook, Jr. discloses a grip control glove for a handgun which includes a covering for a person's hand having a pocket through which a handle of the gun may be inserted. The glove has a structure for securing the covering to the person's wrist so that the person may relax his or her hold on the handle periodically and still have his or her hand secured to the handle of the gun. This glove, however, does not allow for mobility of the person's hand and may be cumbersome.

U.S. Pat. No. 5,414,868 to Crawford discloses a glove with straps having a fastener portion where the fastener portions mate with fasteners on the back of the glove in order to secure an object within the wearer's hand. This patent, however, does not disclose and would not be suitable for holding a gun.

Also, U.S. Pat. No. 2,522,344 to Carmin discloses a glove for holding objects. The glove consists of a strap which encircles the object to be secured, extends around the wearer's hand, and is fastened on the back of the person's hand by a buckle or the like. This patent, however, is rather complex and does not allow for easily and quickly releasing the object that is seized which may be necessary when a police officer is pursuing a person and needs to release his or her gun.

SUMMARY OF THE INVENTION

The present invention overcomes the deficiencies of the prior art described above. It is an object of this invention to provide a glove which supports a gun even when the person wearing the glove is not actively gripping the gun.

It is another object of the invention to provide a glove with a strap which supports a gun but can quickly and easily be fastened or released.

In accordance with the illustrative embodiments, demonstrating features and advantages of the present invention, there is provided a glove which includes a covering for a hand of a person. The covering has a back side, a palm side, an extended thumb section, and separate finger sections for each finger. The thumb and finger sections may be closed or open. The thumb section has a slit therethrough. The glove has a strap with two ends where one end extends from the thumb slit and the other end extends from an opening in a finger section, with the mid-portion of the strap extending within the covering. The ends of the strap have fasteners thereon so that the two ends may be fastened together and through which the handle of the gun may be supported.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
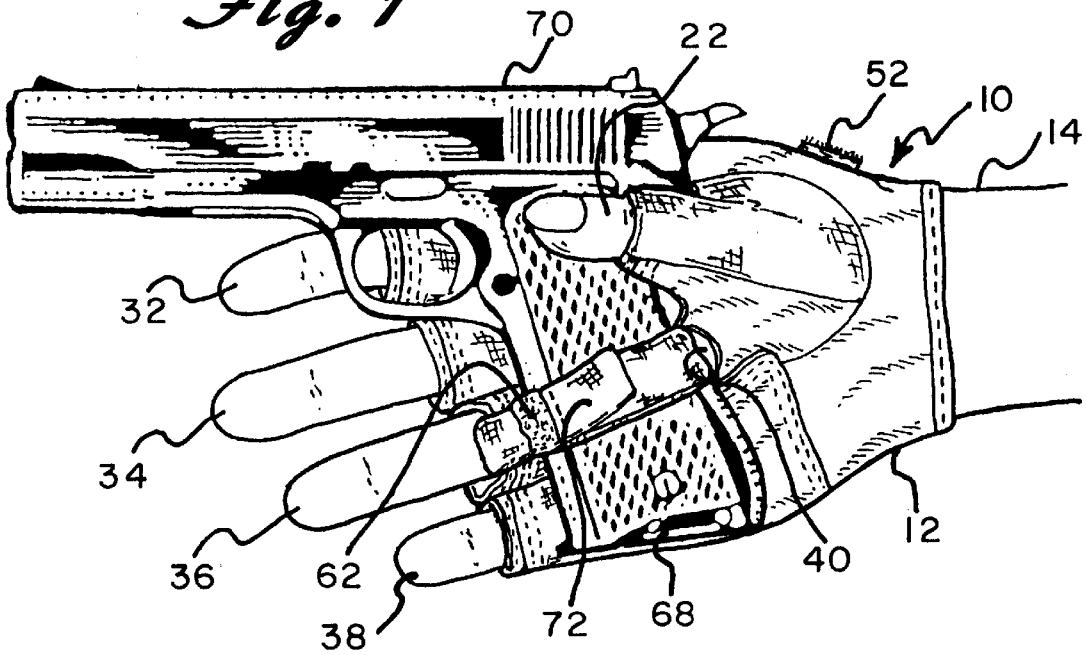
FIG. 1 is a front perspective view of a first embodiment of the gun support glove with open fingers.

Referring now to the drawings in detail wherein like reference numerals have been used throughout the various figures to designate like elements, there is shown in FIG. 1 a gun support glove constructed in accordance with the principles of the present invention and designated generally as 10.

Figure 2:
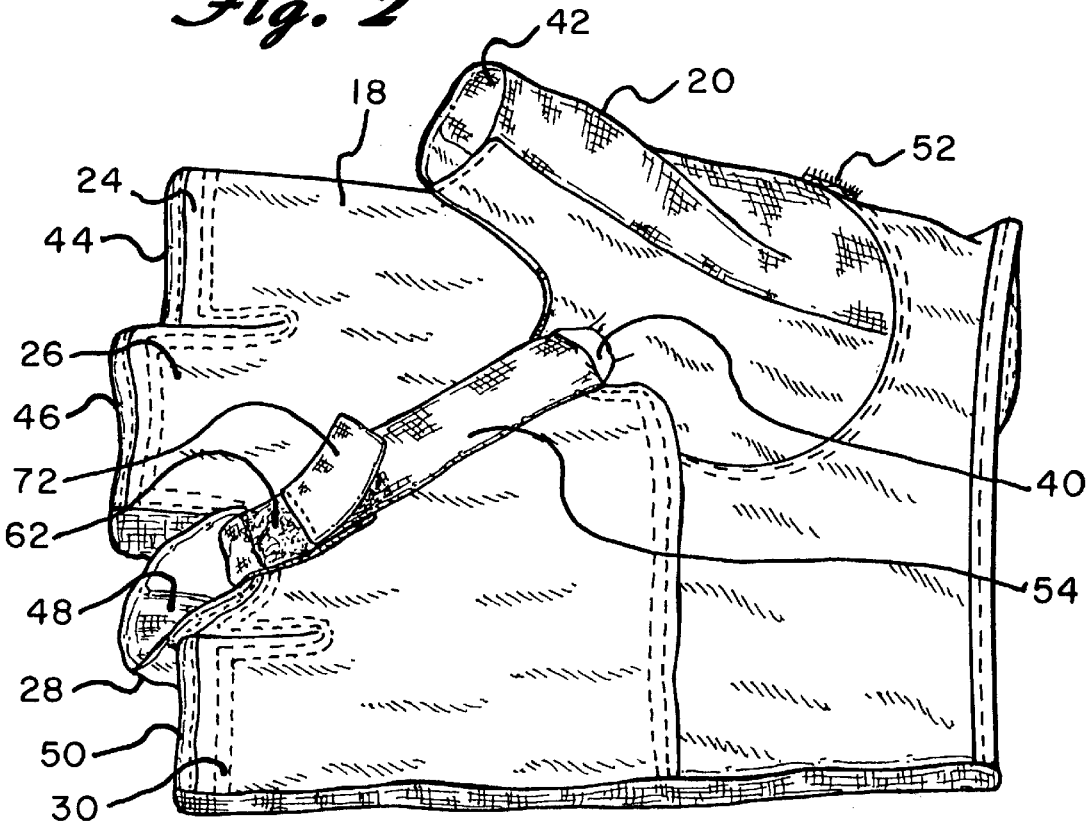
FIG. 2 is a front perspective view of the first embodiment of the glove with the strap in a fastened position.

In the preferred embodiment, the glove 10 essentially includes a covering 12 for a hand 14 of a person, the covering 12 has a back side 16, a palm side 18, an extended thumb section 20 for the thumb 22, and separate finger sections 24, 26, 28, and 30 for each finger 32, 34, 36, and 38, respectively. The thumb section 20 has a slit 40 therethrough. The thumb section 20 and finger sections 24, 26, 28, and 30 are open or have holes 42, 44, 46, 48, and 50 through which the thumb 22 and fingers 32, 34, 36, and 38 extend, respectively. (See FIGS. 1 and 2.) The glove 10 may be made from nylon, leather, or any type of fabric typically used to make gloves. Located on the back side 16 of the covering 12, and behind the thumb section 20 generally, is a fastener section 52 which may be Velcro, or any other type of fastening means. The function of the fastener section 52 will be described in greater detail below.

The glove 10 also has a strap 54 with a first end 56 and a second end 58 where end 56 extends from the thumb slit 40. The mid-portion of the strap 54 extends through the interior of the covering 12 and end 58 extends out of the hole 48 of the finger section 28. Preferably, the end 58 of the strap 54 extends through the hole 48 found in the finger section 28 for the third finger. However, the end 58 of the strap 54 may extend through any of the holes of the finger sections.

Figure 5:
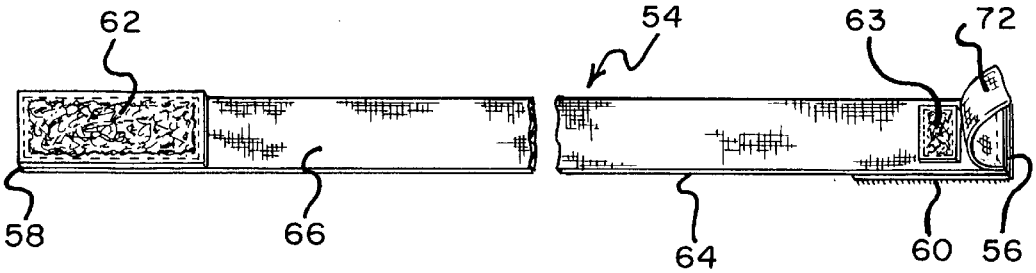
FIG. 5 is a rear perspective view of the strap of the glove of the first embodiment.

The strap 54 has means for fastening 60 on the front side 64 and a first means for fastening 62 on the rear side 66 of the strap 54. (See FIG. 5.) The means for fastening 60 and 62 are preferably Velcro or a hook and loop type fastener. The two fastening means 60 and 62 may be joined together so that the handle 68 of a gun 70 may be supported by the glove 10 without the person wearing the glove 10 actively gripping the gun 70. (This will be discussed in more detail below.) The strap 54 also has a flap 72 which may be used to unfasten the strap 54. The strap 54 and flap 72 may be made from nylon, leather, or the like typically used to make straps. Also on the rear side 66 of the strap 54 beneath the flap 72 is a second means for fastening 63, the function of which will be discussed below.

Figure 6:
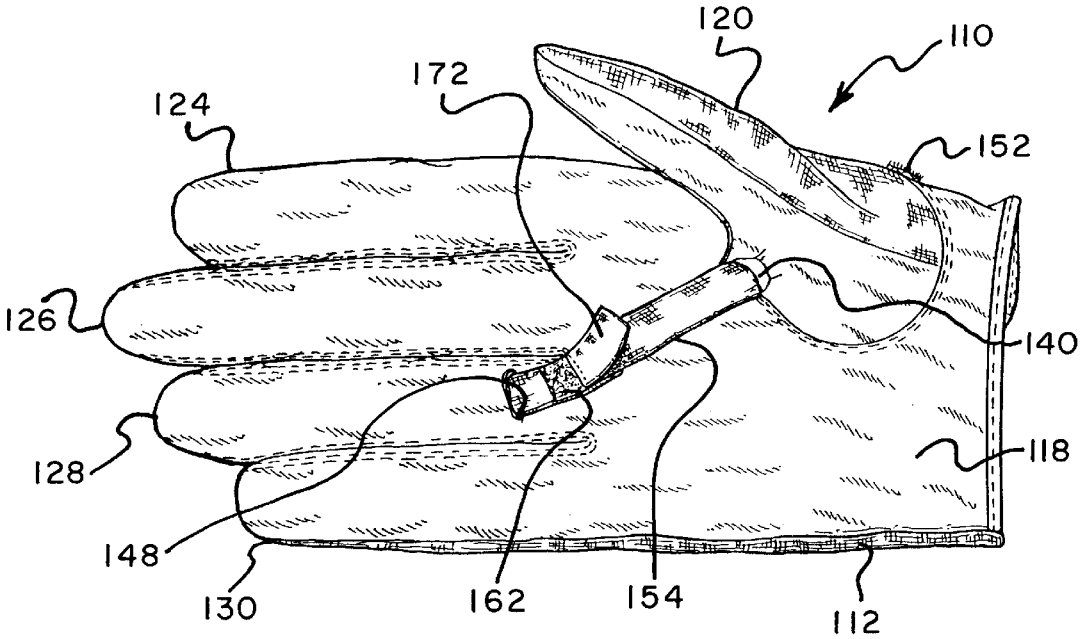
FIG. 6 is a front perspective view of a second embodiment of the glove with closed fingers.

In a second embodiment of the invention, the glove 110 also has a covering 112 for a hand of a person, the covering 112 has a back side, a palm side 118, an extended thumb section 120 for the thumb, and a finger section 124, 126, 128, and 130 for each finger, respectively. Unlike the first embodiment, in this embodiment the thumb and finger sections 120, 124, 126, 128, and 130, respectively, through which the thumb and fingers extend are closed. (See FIG. 6.) The thumb section 120 has a slit 140 therethrough. Preferably, the third finger section 128 has an opening in the form of a slit 148 therethrough. However, any of the fingers sections may have a slit. Again, the glove 110 may be made from nylon, leather, or any type of fabric generally used to make gloves. Located on the back side of the covering 112, and behind the thumb section 120 generally, is a fastener section 152 which may be Velcro, or any other type of fastening means.

In this embodiment as in the first embodiment, the glove 112 has a strap 154 with a first end and a second end where the first end extends from the thumb slit 140. The mid-portion of the strap 154 extends through the interior of the covering 112 and the second end extends out of the slit 148 of the finger section 128. Preferably, the second end of the strap 154 extends from the slit 148 found in the finger section 128 for the third finger.

The strap 154 also has means for fastening on the front side and a first means for fastening 162 on the rear side of the strap 154. The means for fastening are preferably Velcro or a hook and loop type fastener. As in the first embodiment, the means for fastening may be joined together so that the handle of a gun may be supported by the glove 110 without the person wearing the glove actively gripping the gun, as will be discussed in more detail below. The strap 154 also has a flap 172 which may be used to unfasten the strap 154. The strap 154 and flap 172 may be made from nylon, leather, or the like typically used to make straps. Also on the rear side of the strap 154 beneath the flap 172 is a second means for fastening (not shown), the function of which will be discussed below.

The glove of the present invention will now be described with reference to the first embodiment as an example. (It should be noted, however, that the glove described in the second embodiment is used in the same manner, the only differences being that the thumb and finger sections are closed and that the third finger section has a slit therethrough.)

The strap 54 is placed within the covering 12 so that the first end 56 extends from the slit 40 in the thumb section 20; the mid-portion of the strap 54 extends through the interior of the covering 12; and the second end 58 extends outwardly through the hole 48 in the third finger section 28. A person then inserts his or her hand through the thumb and finger sections 20, 24, 26, 28, and 30, respectively, with the strap 54 already in place. The person wearing the glove then grips the handle 68 of a gun 70 so that the handle 68 rests in the palm of his or her hand. The second end 58 of the strap 54 is then pulled and extended over the handle of the gun and the fastener 60, on the front side 64 of the strap 54 is joined to the fastener 62 on the rear side 66 of the strap 54. In this manner, the person wearing the glove may release his or her grip on the gun and the gun will remain supported by the glove.

Figure 3:
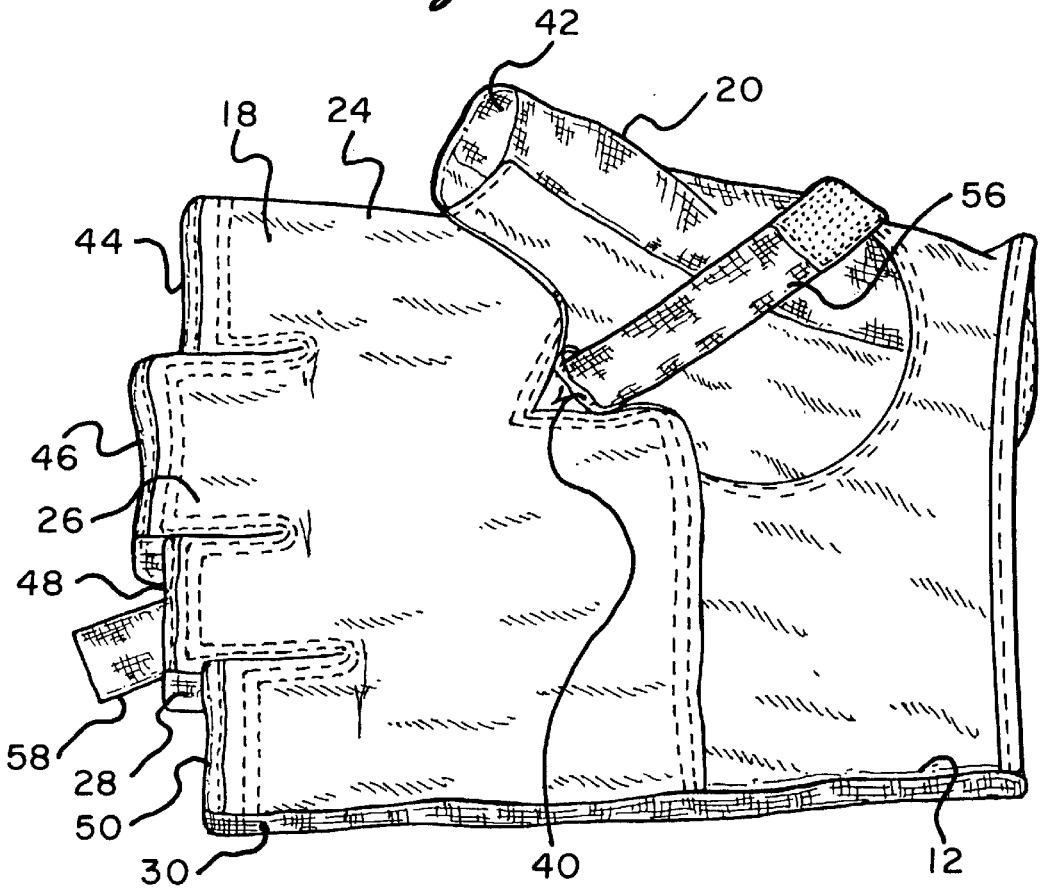
FIG. 3 is front perspective view of the first embodiment of the glove with the strap in an unfastened position.
Figure 4:
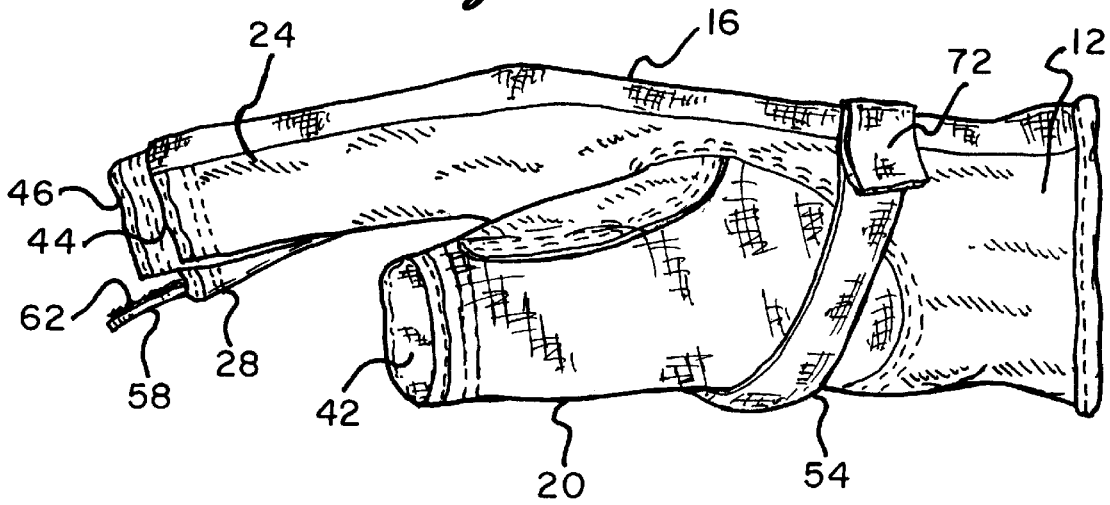
FIG. 4 is a side view of the first embodiment of the glove with the strap fastened to the back of the glove.

Again looking at the first embodiment, in order to release the gun the fasteners 60 and 62 must be released. Flap 72 may be grasped and pulled in order to unfasten the strap. The rear fastener 63 of the strap may then be fastened to the fastening means 52 on the back of the covering as seen in FIGS. 3 and 4 so that the first end 56 of the strap 54 will not be in the way. As the first end 56 of the strap 54 is pulled in order to secure the first end 56 of the strap 54 to the rear fastener 52, the length of the second end 58 of the strap 54 extending through the hole 48 of the third finger section 28 is decreased. Thus, the second end 58 of the strap is out of the way, but remains extended enough so that the second end 58 may be pulled again in order to support the gun as described above.

As an alternative to using the flap to release the fasteners, a two-pronged pick made from plastic may be attached to the belt of the person wearing the glove and may be used to unfasten or pry open the fastened strap. One prong of the pick is simply slid between the fasteners, thereby releasing the contact between the two fasteners. In this manner, the person wearing the glove does not need to use his or her free hand to release the gun from the glove.

The present invention may be embodied in other specific forms without departing from the spirit or essential attributes thereof and accordingly, reference should be made to the appended claims rather than to the foregoing specification as indicating the scope of the invention.

I claim:

1. A glove for supporting a handgun comprising:

a covering for a hand of a person, said covering having a back side, a palm side, an extended thumb section, and separate finger sections for each finger, at least one of said finger sections having an opening therethrough;

said thumb section having a slit therethrough;

a strap having a first end, a second end, and a mid-portion, said first end extending through said thumb slit, said mid-portion of said strap extending within said covering, and said second end extending through said finger opening; and said strap having means for fastening said first and second ends together so that the handle of the gun is supported therein.

2. The glove as claimed in claim 1 wherein said means for fastening includes a hook and loop fastener.

3. The glove claimed in claim 1 wherein said back side of said covering has means for fastening said strap to said back side.

4. The glove claimed in claim 1 wherein said strap includes means for aiding a person to unfasten said strap.

5. The glove claimed in claim 4 wherein said means for aiding is a flap.

6. The glove claimed in claim 1 wherein said thumb section and said finger sections are open.

7. The glove claimed in claim 1 wherein said opening is a hole in the third finger section.

8. The glove claimed in claim 1 wherein said thumb section and said finger sections are closed.

9. The glove as claimed in claim 8 wherein said means for fastening includes a hook and loop fastener.

10. The glove claimed in claim 8 wherein said back side of said covering has means for fastening said strap to said back side.

11. The glove claimed in claim 8 wherein said strap includes means for aiding a person to unfasten said strap.

12. The glove claimed in claim 11 wherein said means for aiding is a flap.

13. The glove claimed in claim 8 wherein said opening is a slit in the third finger section.

* * * * *